US005796317A

United States Patent [19]

Bohlman et al.

[11] Patent Number: 5,796,317

[45] Date of Patent: Aug. 18, 1998

[54] VARIABLE IMPEDANCE TRANSMISSION LINE AND HIGH-POWER BROADBAND REDUCED-SIZE POWER DIVIDER/ COMBINER EMPLOYING SAME

[75] Inventors: Walter Bohlman, Line Lexington; John Greeley, Ambler, both of Pa.

[73] Assignee: Tracor Aerospace Electronic Systems, Inc., Lansdale, Pa.

[21] Appl. No.: 794,128

[22] Filed: Feb. 3, 1997

[51] Int. Cl.[6] ..... H01P 5/12; H01P 3/06

[52] U.S. Cl. ..... 333/127; 174/28; 174/111; 333/243; 333/244

[58] Field of Search ..... 333/127, 136, 333/160, 206, 243–245; 174/28, 111, 126.1

[56] References Cited

U.S. PATENT DOCUMENTS

| | | | |
|---|---|---|---|
| 2,105,060 | 1/1938 | Strom et al. | 174/111 |
| 2,548,881 | 4/1951 | Ferrill, Jr. | 333/244 X |
| 2,877,433 | 3/1959 | Devot | 333/206 |
| 3,091,743 | 5/1963 | Wilkinson | 333/127 |
| 3,371,294 | 2/1968 | Naiman | 333/160 |
| 4,163,955 | 8/1979 | Iden et al. | 333/127 |
| 4,240,051 | 12/1980 | Haugsjaa et al. | 333/127 |
| 4,365,215 | 12/1982 | Landry | 333/127 |
| 4,371,845 | 2/1983 | Pitzalis, Jr. | 330/277 |
| 4,399,419 | 8/1983 | Dobrovolny | 333/245 X |
| 4,556,856 | 12/1985 | Presser | 333/124 |
| 4,875,024 | 10/1989 | Roberts | 333/127 |
| 5,142,253 | 8/1992 | Mallavarpu et al. | 333/127 |

FOREIGN PATENT DOCUMENTS 1214333 4/1960 France .

*Primary Examiner*—Paul Gensler

*Attorney, Agent, or Firm*—Seidel Gonda Lavorgna & Monaco, PC

[57] ABSTRACT

A variable impedance coaxial transmission line having a center conductor of constant cross-section, an outer conductor surrounding and coaxial with the center conductor and spaced radially therefrom, and a variable dielectric constant material between the center conductor and the outer conductor. The variable dielectric constant material has a plurality of alternating elements of high dielectric material and low dielectric material arranged along the center conductor from a first end to a second end of the center conductor. The invention also includes a reduced size, high-power broadband power/divider incorporating the variable impedance coaxial transmission line.

9 Claims, 3 Drawing Sheets

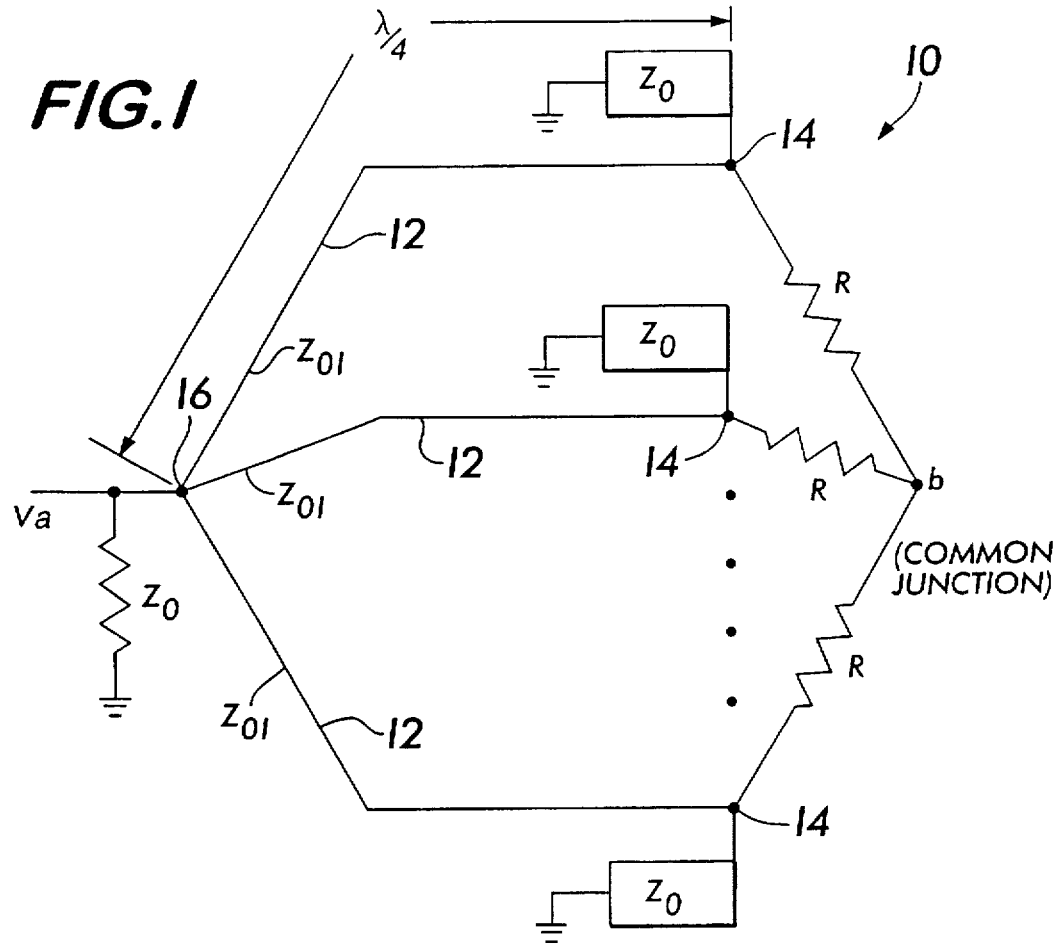
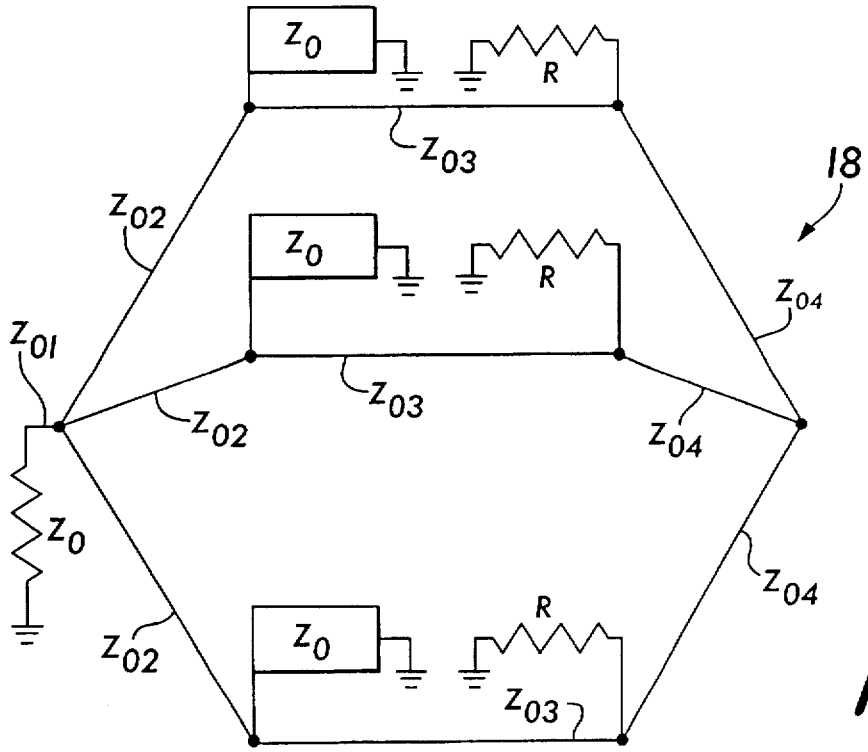
FIG.2

VARIABLE IMPEDANCE TRANSMISSION LINE AND HIGH-POWER BROADBAND REDUCED-SIZE POWER DIVIDER/ COMBINER EMPLOYING SAME

FIELD OF THE INVENTION

The present invention relates to a variable impedance coaxial transmission line and a high-power broadband reduced size power divider/combiner incorporating the transmission line.

BACKGROUND OF THE INVENTION

The best-known and most commonly used N-way power divider/combiner for RF energy was described by Ernest J. Wilkinson in "An N-Way Hybrid Power Divider," *IRE Transactions on Microwave Theory and Techniques*, Vol. MTT-8, pp. 116–118 (January 1960). Wilkinson obtained a patent, U.S. Pat. No. 3,091,743, for the N-way power divider/combiner. The Wilkinson power divider, as it has come to be called, uses the technique of combining N loads or sources and achieving isolation between the loads or sources. The Wilkinson power divider offers matched conditions at all ports, a lower insertion loss, and high isolation between output/input ports. The first design used quarter-wavelength transmission lines uniformly arranged in a cylinder to obtain isolation between ports by having reflected signals combine 180 degrees out of phase. Discrete isolation resistors are arranged in a star network in which each resistor has one end connected to a common point and the other end connected to a different one of the transmission lines one-quarter wavelength from a common junction of that transmission line with the other transmission lines. The discrete isolation resistors are disposed in a plane perpendicular to the axis of the cylinder.

The Wilkinson power divider has bandwidth limitations which relate to the number of loads represented by the integer N. Bandwidth improvements can be achieved by cascading multiple sections of Wilkinson dividers, the idea being that only a very small impedance change took place in each section, and each section had its own load. This approach was expanded to one in which a variable impedance coaxial transmission line, with a continuously tapered resistor instead of a discrete isolation resistor network, was used to connect multiple ports to the single port. The continuously tapered resistor absorbs any load imbalance. This approach is particularly applicable to printed circuit manufacturing technology, where tapered resistors are relatively easy to realize. This technique presents a problem for high power applications, however. As the resistor tapers, its cross-section necessarily decreases. This leads to hot spots where the resistor has the smallest cross-section.

To avoid this problem, the cross-section was maximized by using a low dielectric constant circuit board as the substrate for the tapered resistor. This solution, however, results in lines that are quite long. Reducing the length of the lines by resorting to a high dielectric constant substrate also reduces the cross-section, which, of course, leads to hot spots.

Thus, design constraints usually require either very long transmission lines or limit the amount of power that can be handled. There is a need for a transmission line which overcomes these problems, and which has a constant cross section to avoid hot spots and which is short enough to fit into a small package.

SUMMARY OF THE INVENTION

The present invention overcomes these problems by providing a coaxial transmission line with a constant conductor cross-section for high power handling capability, and which transforms the transmission line impedance continuously from one end to the other to give very broad bandwidth.

The present invention encompasses a variable impedance coaxial transmission line, comprising a center conductor of constant cross-section, an outer conductor surrounding and coaxial with the center conductor and spaced radially therefrom, and a variable dielectric constant material between the center conductor and the outer conductor. The variable dielectric constant material comprises a plurality of alternating elements of high dielectric material and low dielectric material arranged along the center conductor from a first end to a second end of the center conductor.

The invention also comprehends a high-power reduced size power divider/combiner for RF energy incorporating the variable impedance transmission line. The high-power reduced size power divider/combiner comprises a plurality of quarter-wavelength transmission lines each comprising a center conductor of constant cross-section, an outer conductor surrounding and coaxial with the center conductor and spaced radially therefrom, and a variable dielectric constant material between the center conductor and the outer conductor, comprising a plurality of alternating elements of high dielectric material and low dielectric material arranged along the center conductor from a first end to a second end thereof. The center conductors of said transmission lines are connected together at one of said first and second ends. A signal port is provided for coupling a signal to said one of said first and second ends. A like plurality of resistors, each having a preselected resistance, is arranged with one terminal of each resistor being connected to the other of said first and second ends of corresponding ones of said center conductors. The other terminals of said resistors are connected together at a common point. A like plurality of signal ports is connected to said other ends of said center conductors.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a simplified schematic diagram of an N-way Wilkinson power divider.

FIG. 2 is a simplified schematic diagram of an high-power N-way Wilkinson power divider.

DESCRIPTION OF THE INVENTION

Figure 3:
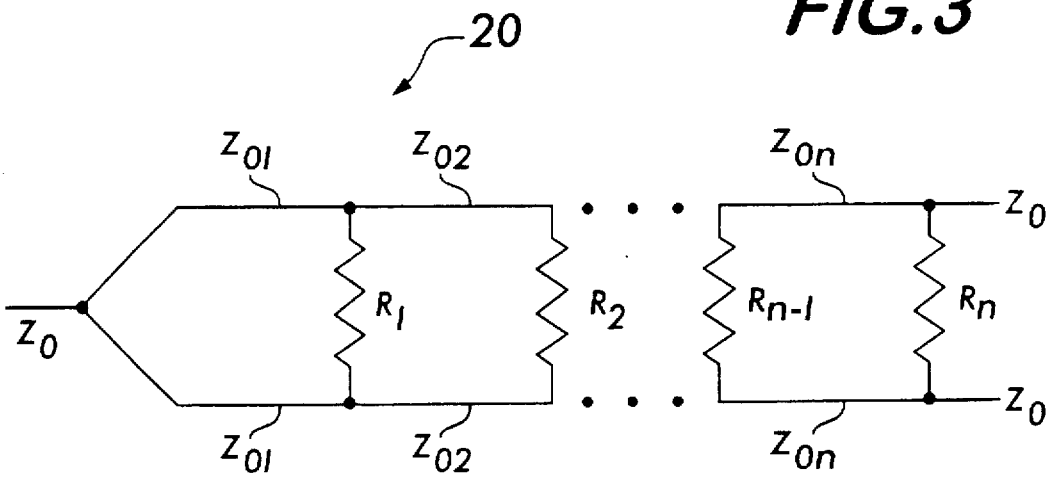
FIG. 3 is a simplified schematic diagram of a multisection Wilkinson power divider to broaden bandwidth.

Referring now to the drawings, wherein like numerals indicate like elements, there is shown in FIG. 1 a schematic diagram of an N-way Wilkinson power divider 10. The input and output impedances are all $Z_0$. The input signal $V_a$ is applied to N parallel quarter-wavelength transmission lines 12, each of which has a characteristic impedance $Z_{01}$. At the output ports 14 of each of the transmission lines 12, resistors of value R are connected to a common junction b. The resistor R is equal to $Z_0$, and $Z_{01}$ is determined from the equation $$Z_{01} = \sqrt{N} \cdot Z_0$$

If the values of R and $Z_{01}$ are chosen as described above, the output ports 14 will be completely isolated and matched. The input impedance under these conditions will also be matched to the resistance R.

As those skilled in the art will understand, when a signal $V_a$ is applied at the input of the power divider, it divides into N equiphase equiamplitude ports. No power is dissipated by the resistors R when matched loads are connected to the outputs, since all the transmission lines will be at the same potential. However, if a reflection occurs at one of the output ports 14, the reflected signal will split. Part of the reflected signal will travel directly to the other output ports via the resistors R, and the rest of the signal will travel back to the input, splitting again at the junction 16 of the transmission lines 12 and then returning to the remaining output ports 14. The reflected wave arrives at the remaining output ports 14 in two parts, and the difference in length between the two paths travelled by the two parts of the signal will result in the two parts of the signal being 180 degrees out of phase when the transmission lines 12 are one-quarter wavelength long. Thus, if the resistors R, the characteristic impedance $Z_{01}$, and the input impedance $Z_0$ are selected as described above, the reflected signals from the two different paths will completely cancel each other out at all of the loads $Z_0$, providing good isolation between the output ports 14.

The transmission lines 12 are all one-quarter wavelength long at the center of the operating band. Sometimes, the impedances calculated from the above equation is rather high, in the hundreds of ohms. Narrow conductors are required to generated the high characteristic impedances. Narrow conductors can increase the insertion loss of the power divider, and could cause a power handling problem.

One approach to improving the power handling capability of a Wilkinson power divider is illustrated schematically in FIG. 2. In the Wilkinson power divider shown in FIG. 1, the isolation resistors R must be physically small in size, and are difficult to heat sink for high-power applications. In the circuit 18 shown in FIG. 2, instead of a network of resistors connected between the output ports 14 and a common junction b, an additional network of transmission lines $Z_{03}$ (all one-quarter wavelength at midband) and shunt resistors R, which can be made as external loads, is used. In the power divider represented schematically by circuit 18, the resistors R are no longer critical to the operation of the circuit, and each resistor R can be placed in a shunt-to-ground connection at the end of a matched transmission line $Z_{04}$ of arbitrary length. Thus, standard high power external loads and high power levels can be accommodated by circuit 18.

A significant drawback to circuit 18, however, is that it becomes narrow in bandwidth compared to the circuit illustrated in FIG. 1. To broaden the bandwidth, multisection designs, such as that shown in FIG. 3 have been used. The multisection circuit 20 comprises a series of transmission lines of characteristic impedance $Z_{01}, Z_{02}, Z_{03}, \ldots, Z_{0n}$. The output ports of each transmission line are connected by internal resistors $R_1, R_2, R_3, \ldots, R_n$ respectively. The bandwidth can be broadened further by the continuously tapered design 22 illustrated in FIG. 4. In that approach, two transmission lines 24 are joined along their entire length by a continuous, tapered resistor 26. The continuously tapered design 22 is, in effect, a series of infinitely short transmission lines connected by an infinite number of internal resistors, and represents a realization of the multisection circuit 20 where n is equal to infinity.

The continuously tapered design is, however, subject to the same power handling problems the circuit 10 of FIG. 1 is subject to. As one moves closer to the input port 28, there is less and less resistor between the transmission lines 24, and the current density becomes extremely high, leading to hot spots and heat sinking problems. Thus, designers are forced to trade off size and power handling capability for bandwidth.

Figure 5:
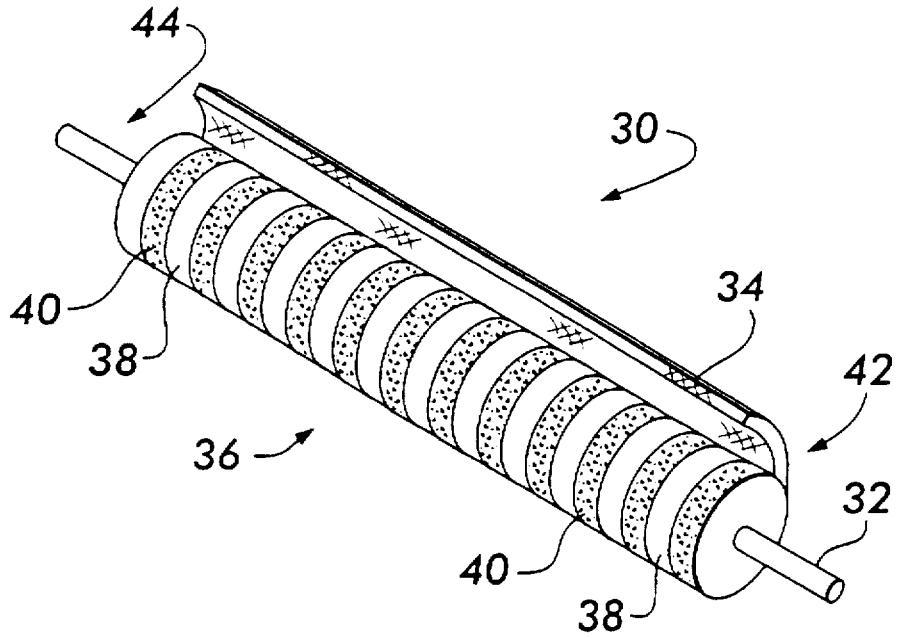
FIG. 5 is a simplified diagram of a variable impedance coaxial transmission line according to the invention.

A transmission line 30 according to the present invention, which eliminates this tradeoff, is illustrated in FIG. 5. The transmission line 30 is a coaxial transmission line and comprises a center conductor 32 of constant cross-section and an outer conductor, or shield, 34, which is only partially shown for clarity, and which is spaced radially from the center conductor 32. The space between the center conductor 32 and the outer conductor 34 is occupied by a dielectric material 36. Dielectric material 36 comprises a plurality of alternating disks of low-dielectric constant material 38 and high-dielectric constant material 40 arranged along the center conductor from a first end 42 to a second end 44. Not all of the low-dielectric constant disks 38 and high-dielectric constant disks 40 need have the same dielectric constant. Instead, the dielectric constants of the individual disks can vary along the length of the center conductor, as long as disks of alternating high and low dielectric constant are used.

By way of example, and not by limitation, the low-dielectric constant disks 38 adjacent first end 42 may have a dielectric constant k of 1.4 and the high-dielectric constant disks 40 adjacent first end 42 may have a dielectric constant k of 2, while the low-dielectric constant disks 38 adjacent second end 44 may have a dielectric constant k of 6 and the high-dielectric constant disks 40 adjacent second end 44 may have a dielectric constant k of 10. The low-dielectric constant disks 38 and the high-dielectric constant disks 40 in the center portion of transmission line 30 between first end 42 and second end 44 may have a dielectric constants k between 2 and 6. By arranging alternating disks of high-dielectric constant and low-dielectric constant materials along the center conductor, the dielectric constant can be made variable as a function of position along the center conductor. This, in turn, permits a continuous impedance transformation along the transmission line 30 from one end to the other to give very broad bandwidth. In the example given above, the impedance is transformed continuously from a high impedance at first end 42 to a low impedance at second end 44.

Figure 4:
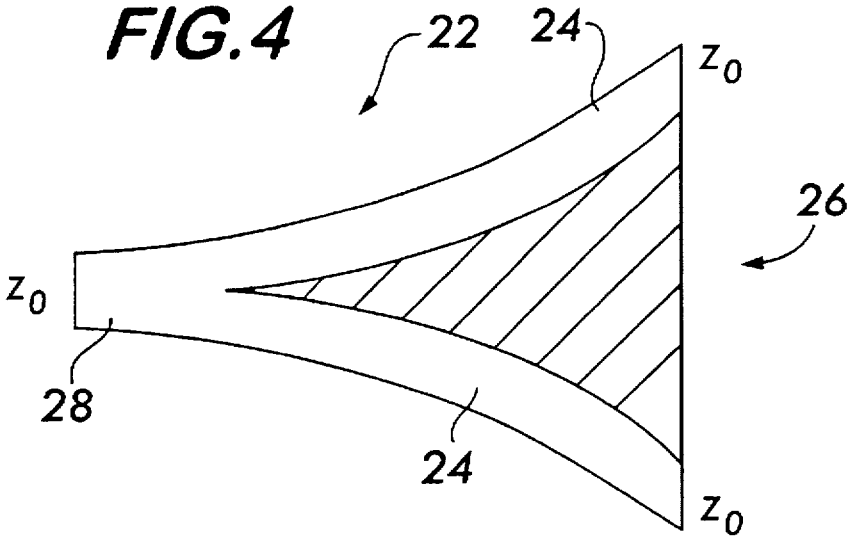
FIG. 4 is a simplified diagram of a continuously tapered Wilkinson power divider according to the prior art.

The constant cross-section of the center conductor 32 permits the transmission line 30 to handle higher power than the continuously tapered design 22 illustrated in FIG. 4, since there is no need to reduce the cross sectional area to increase the impedance of the transmission line. At the same time, the impedance varies continuously along the length of the transmission line 30 to provide a broad bandwidth.

Figure 6:
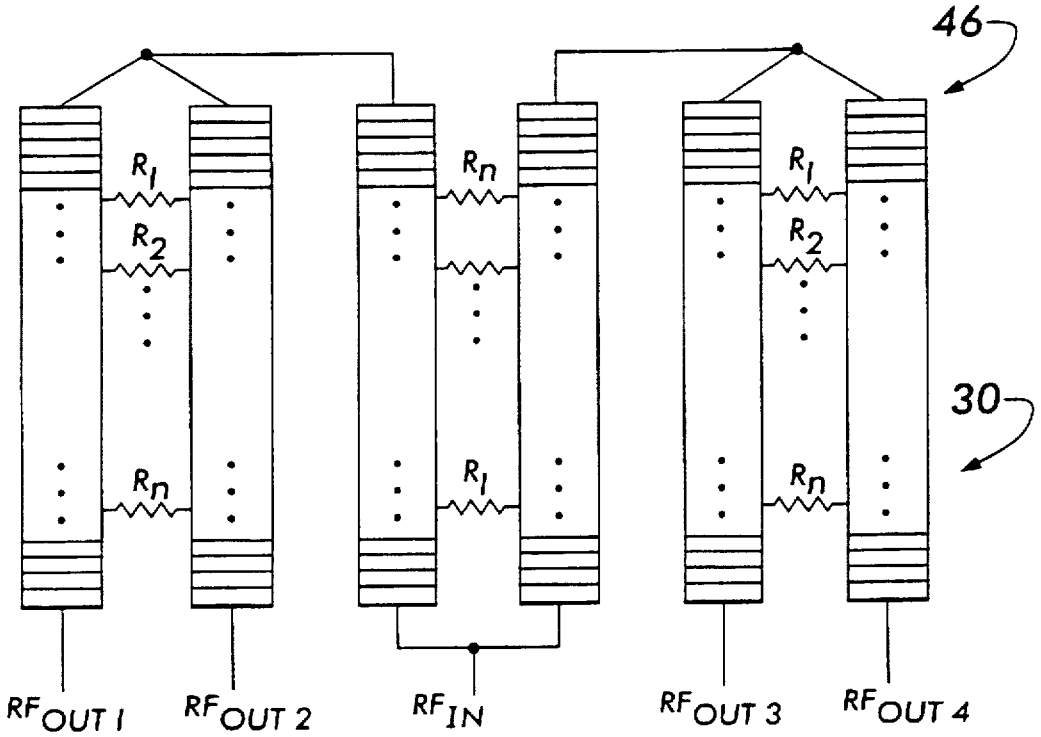
FIG. 6 is a simplified schematic diagram of a Wilkinson power divider according to the invention, incorporating variable impedance coaxial transmission lines of the type illustrated in FIG. 5.

A power divider circuit 46 utilizing the transmission line 30 of the present invention is illustrated in FIG. 6. Circuit 46 is, by way of example, a four-way power divider, in which an RF input signal $RF_{in}$ is divided into four RF output signals $RF_{out1}$, $RF_{out2}$, $RF_{out3}$, and $RF_{out4}$. Circuit 46 has a system input/output impedance $Z_0$, such as, for example, 50Ω. Thus, the input terminal for $RF_{in}$ and the four output terminals for $RF_{out1}$, $RF_{out2}$, $RF_{out\ 3}$, and $RF_{out4}$ each have a characteristic impedance of $Z_0$, or in this example 50Ω. The RF input signal at $RF_{in}$ is divided into two signals, each of which is transmitted along two variable impedance quarter-wavelength transmission lines 30 according to the invention. By selecting the dielectric constant of the alternating disks 38 and 40, the transmission lines 30 may be made to have an impedance of twice $Z_0$ at the ends opposite $RF_{in}$, or in this example 100Ω. (Resistors $R_1$, $R_2$, $R_3$, . . . , $R_n$ correspond to the internal resistors $R_1$, $R_2$, $R_3$, . . . , $R_n$ in FIG. 3, respectively.) The RF input signal is then divided again into two signals, and each of those signals is transmitted along two further variable impedance transmission lines 30 according to the invention. By selecting the dielectric constant of the alternating disks 38 and 40, the two further transmission lines 30 may be made to have an impedance of $Z_0$ at their output terminals for $RF_{out1}$, $RF_{out2}$, $RF_{out3}$, and $RF_{out4}$, respectively, or in this example 50Ω. Thus, the RF input signal may be divided into four RF output signals very readily, and may accommodate high RF power in a compact package. The power divider circuit 46 will have good isolation and good VSWR, and equal RF power splits over a bandwidth greater that 7:1.

The present invention may be embodied in other specific forms without departing from the spirit or essential attributes thereof and, accordingly, reference should be made to the appended claims, rather than to the foregoing specification, as indicating the scope of the invention.

We claim:

1. A variable impedance coaxial transmission line, comprising a center conductor of constant cross-section, an outer conductor surrounding and coaxial with the center conductor and spaced radially therefrom, and a variable dielectric constant material between the center conductor and the outer conductor, comprising a plurality of alternating elements of high dielectric constant material and low dielectric constant material arranged along the center conductor from a first end to a second end thereof, the ratio of dielectric constants of said alternating elements at said first end being different from the ratio of dielectric constants of said alternating elements at said second end.

2. A variable impedance coaxial transmission line according to claim 1, wherein the alternating elements are arranged along the center conductor to provide a preselected characteristic impedance at the first end and a different preselected characteristic impedance at the second end.

3. A variable impedance coaxial transmission line according to claim 1, wherein the dielectric constant of the variable dielectric constant material varies substantially continuously from the first end to the second end.

4. A variable impedance coaxial transmission line according to claim 2, wherein the characteristic impedance varies substantially continuously from the characteristic impedance at the first end to the characteristic impedance at the second end.

5. A variable impedance coaxial transmission line, comprising a center conductor of constant cross-section, an outer conductor surrounding and coaxial with the center conductor and spaced radially therefrom, and a variable dielectric constant material between the center conductor and the outer conductor, comprising a plurality of alternating elements of high dielectric material and low dielectric material arranged along the center conductor from a first end to a second end thereof, wherein the alternating elements are arranged along the center conductor in a manner such that the dielectric constant of the variable dielectric constant material varies substantially continuously from the first end to the second end to provide a preselected characteristic impedance at the first end and a different preselected characteristic impedance at the second end, and which varies substantially continuously from the characteristic impedance at the first end to the characteristic impedance at the second end.

6. A high-power reduced size power divider/combiner for RF energy, comprising at least two quarter-wavelength transmission lines each comprising a center conductor of constant cross-section, an outer conductor surrounding and coaxial with the center conductor and spaced radially therefrom, and a variable dielectric constant material between the center conductor and the outer conductor, comprising a plurality of alternating elements of high dielectric material and low dielectric material arranged along the center conductor from a first end to a second end thereof, the center conductors of each of said transmission lines being connected together at one of said first and second ends, a signal port for coupling a signal to said one of said first and second ends, a plurality of resistors each having a preselected resistance, each resistor being connected between the center conductors of selected pairs of said transmission lines, and a signal port connected to each of the other of said first and second ends of said center conductors.

7. A high-power reduced size power divider/combiner for RF energy, comprising at least two quarter-wavelength transmission lines each comprising a center conductor of constant cross-section, an outer conductor surrounding and coaxial with the center conductor and spaced radially therefrom, and a variable dielectric constant material between the center conductor and the outer conductor, comprising a plurality of alternating elements of high dielectric material and low dielectric material arranged along the center conductor from a first end to a second end thereof, wherein the alternating elements are arranged along the center conductor in a manner such that the dielectric constant of the variable dielectric constant material varies substantially continuously from the first end to the second end to provide a preselected characteristic impedance at the first end and a different preselected characteristic impedance at the second end, and which varies substantially continuously from the characteristic impedance at the first end to the characteristic impedance at the second end, the center conductors of each of said transmission lines being connected together at one of said first and second ends, a signal port for coupling a signal to said one of said first and second ends, a plurality of resistors each having a preselected resistance, each resistor being connected between the center conductors of selected pairs of said transmission lines, and a signal port connected to each of the other of said first and second ends of said center conductors.

8. A variable impedance coaxial transmission line, comprising a center conductor of constant cross-section, an outer conductor surrounding and coaxial with the center conductor and spaced radially therefrom, and a variable dielectric constant material between the center conductor and the outer conductor, comprising a plurality of alternating elements of high dielectric material and low dielectric material arranged along the center conductor from a first end to a second end thereof, wherein the dielectric constant of the variable dielectric constant material varies substantially continuously from the first end to the second end.

9. A variable impedance coaxial transmission line, comprising a center conductor of constant cross-section, an outer conductor surrounding and coaxial with the center conductor and spaced radially therefrom, and a variable dielectric constant material between the center conductor and the outer conductor, comprising a plurality of alternating elements of high dielectric material and low dielectric material arranged along the center conductor from a first end to a second end thereof to provide a preselected characteristic impedance at the first end and a different preselected characteristic impedance at the second end, wherein the dielectric constant of the variable dielectric constant material varies substantially continuously from the first end to the second end.

* * * * *